United States Patent [19]

Van Gordon et al.

[11] Patent Number: 5,005,734

[45] Date of Patent: Apr. 9, 1991

[54] FLEXIBLE POUCH WITH REINFORCEMENT TO FACILLITATE POURING

[75] Inventors: Todd D. Van Gordon, Basking Ridge; John H. Swanson, Bloomfield; Knud N. Kristensen, Fair Haven, all of N.J.; Adam Sherman, Brooklyn, N.Y.

[73] Assignee: Colgate-Palmolive Company, Piscataway, N.J.

[21] Appl. No.: 327,659

[22] Filed: Mar. 23, 1989

[51] Int. Cl.[5] ..... B65D 35/08

[52] U.S. Cl. ..... 222/107; 222/527; 383/119; 383/906

[58] Field of Search ..... 222/92, 107, 527, 528, 222/541, 566, 572–574, 105; 383/46, 119, 906

[56] References Cited

U.S. PATENT DOCUMENTS

| | | | |
|---|---|---|---|
| 2,446,308 | 8/1948 | Smith | 229/14 |
| 2,620,944 | 12/1952 | Stahl | 222/107 |
| 2,866,488 | 3/1956 | Thompson | 150/5 |
| 2,999,627 | 9/1961 | Reinhardt | 229/55 |
| 3,112,047 | 11/1963 | Weinrich et al. | 222/105 |
| 3,171,581 | 3/1965 | Kugler | 229/53 |
| 3,249,286 | 5/1966 | Palmer | 383/119 |
| 3,380,646 | 4/1968 | Doyen et al. | 229/57 |
| 3,381,874 | 5/1968 | Russo | 383/906 |
| 3,402,741 | 9/1968 | Yurdin | 222/527 |
| 3,437,258 | 8/1969 | Kugler | 229/58 |
| 3,463,357 | 8/1969 | MacLean, Jr. et al. | 222/94 |
| 3,473,703 | 10/1969 | Lippincott | 222/215 |
| 3,565,147 | 2/1971 | Ausnit | 383/119 |
| 3,815,794 | 6/1974 | Carlisle | 222/491 |
| 3,907,164 | 9/1975 | Stich | 222/3 |
| 3,935,993 | 2/1976 | Doyen et al. | 229/53 |
| 3,984,047 | 10/1976 | Clayton et al. | 383/119 |
| 4,015,635 | 4/1977 | Goransson | 138/119 |
| 4,119,128 | 10/1978 | Bishop | 150/8 |
| 4,285,376 | 8/1981 | Ausnit | 150/3 |
| 4,353,497 | 10/1982 | Bustin | 229/55 |
| 4,454,979 | 6/1984 | Ikeda et al. | 229/52 B |
| 4,498,591 | 2/1985 | Smith, II | 206/620 |
| 4,578,813 | 3/1986 | Ausnit | 383/65 |
| 4,592,938 | 6/1986 | Benoit | 383/119 |
| 4,708,705 | 11/1987 | Aubry et al. | 383/46 |
| 4,732,299 | 3/1988 | Hoyt | 222/107 |

FOREIGN PATENT DOCUMENTS

| | | |
|---|---|---|
| 572976 | 9/1962 | Belgium . |
| 1366310 | 6/1964 | France . |

*Primary Examiner*—H. Grant Skaggs
*Assistant Examiner*—Steve Reiss
*Attorney, Agent, or Firm*—Michael J. McGreal; Robert C. Sullivan; Murray M. Grill

[57] ABSTRACT

A flexible pouch made from at least one layer of plastic material bonded to form a closed inner chamber for storing liquid. Peripheral portions of the wall material are contoured and then bonded to form a closed pouring spout at a corner of the pouch. The configuration of the spout is defined by the contour of the bonding in the vicinity of that pouch corner. The pouring spout is opened by cutting the pouch corner at an angle. The flexible walls of the pouch are reinforced in the vicinity of the pouring spout to prevent folding. The open spout is intended to be inserted in the open neck of a container to be refilled.

10 Claims, 8 Drawing Sheets

FLEXIBLE POUCH WITH REINFORCEMENT TO FACILLITATE POURING

FIELD OF THE INVENTION

This invention relates to a flexible pouch made of laminated material used for refilling other containers with liquid, and in particular, to a flexible pouch with reinforcement adjacent to a pouring spout to facilitate pouring.

BACKGROUND OF THE INVENTION

Conventional flexible pouches having a spout for pouring liquid stored therein are disclosed in U.S. Pat. Nos. 4,285,376, 4,491,245 and 4,578,813. Such conventional flexible pouches suffer from the disadvantage that during pouring, the pouch is susceptible to folding which blocks the discharge of liquid through the pouring spout.

The use of flexible pouches liquids made of laminations of plastic material to dispense liquids is well known. One such pouch is disclosed in U.S. Pat. No. RE 24,251.

A pouch made of metallic foil and having a contoured pouring spout is disclosed in U.S. Pat. No. 3,907,164. However, this conventional package has a reduced storage capacity due to the shape of the container and has no means for facilitating the pouring of liquid from the container into the neck of another container. The latter disadvantage is because when the pouch is turned to the pouring position, its pouring spout does not make use of the contoured configuration. On the contrary, the contour merely serves to define the pouring spout and not to receive the neck of another container.

SUMMARY OF THE INVENTION

The object of the invention is to overcome the foregoing disadvantages of conventional flexible pouches for storing liquids.

More specifically, it is an object of the invention to provide a sealed flexible pouch having a reinforced structure which facilitates the pouring of liquid from the pouch into another container.

It is a further object of the invention to provide a pouch in which the spout is not blocked during pouring by folding of the flexible walls of the pouch.

The flexible pouch in accordance with the preferred embodiments of the invention is made from at least one layer of plastic material sealed to form a closed inner chamber for storing liquid. Alternatively the pouch may have laminated walls comprising a layer of foil adhered to a layer of plastic.

A pouch in accordance with the preferred embodiments of the invention has a peripheral edge formed by fin sealing two layers of wall material together. In accordance with one preferred embodiment, two sheets of wall material are fin-sealed together along their entire peripheries. In accordance with another preferred embodiment, one portion of the peripheral edge of a folded single sheet of wall material is fin-sealed to the remaining portion of the peripheral edge of that single sheet. In accordance with yet another embodiment, a rigid fitment is bonded to mutually opposing peripheral edges of two layers of wall material, while the remainder of the peripheries of the two layers are fin-sealed together.

A self-standing pouch in accordance with the preferred embodiments of the invention is gusseted at its bottom to enable the pouch to stand in an upright position when filled with liquid.

In accordance with the preferred embodiments without a rigid fitment, peripheral portions of the wall material are contoured and then heat-sealed or joined by adhesion to form a closed pouring spout at a corner of the pouch. The configuration of the spout is defined by the contour of the sealing in the vicinity of that pouch corner. The pouring spout is opened by cutting the pouch corner at an angle.

In accordance with the preferred embodiments of the invention, the sealed periphery has a generally rectangular contour, except that the contour of the sealed peripheral edge has an inwardly curved portion corresponding to a recess in the wall material, which recess partly defines the spout configuration.

Blockage of the pouring spout due to folding of the flexible wall material is prevented in accordance with the invention by providing means for reinforcing the wall material in the vicinity of the pouring spout, in particular, along the top peripheral edge of the pouch. The reinforcement is secured to either the inside or the outside of the pouch wall.

In accordance with another preferred embodiment of the invention, the reinforcement means is a rigid fitment which serves the dual purpose of sealing the pouch chamber along opposing peripheral edges of the wall material.

Other objects of the invention will be apparent from the detailed description of the invention hereinafter.

BRIEF DESCRIPTION OF THE DRAWINGS

The preferred embodiments of the invention will be described in detail hereinafter with reference to the accompanying drawings, wherein.

DETAILED DESCRIPTION OF THE PREFERRED EMBODIMENTS

Figure 1:
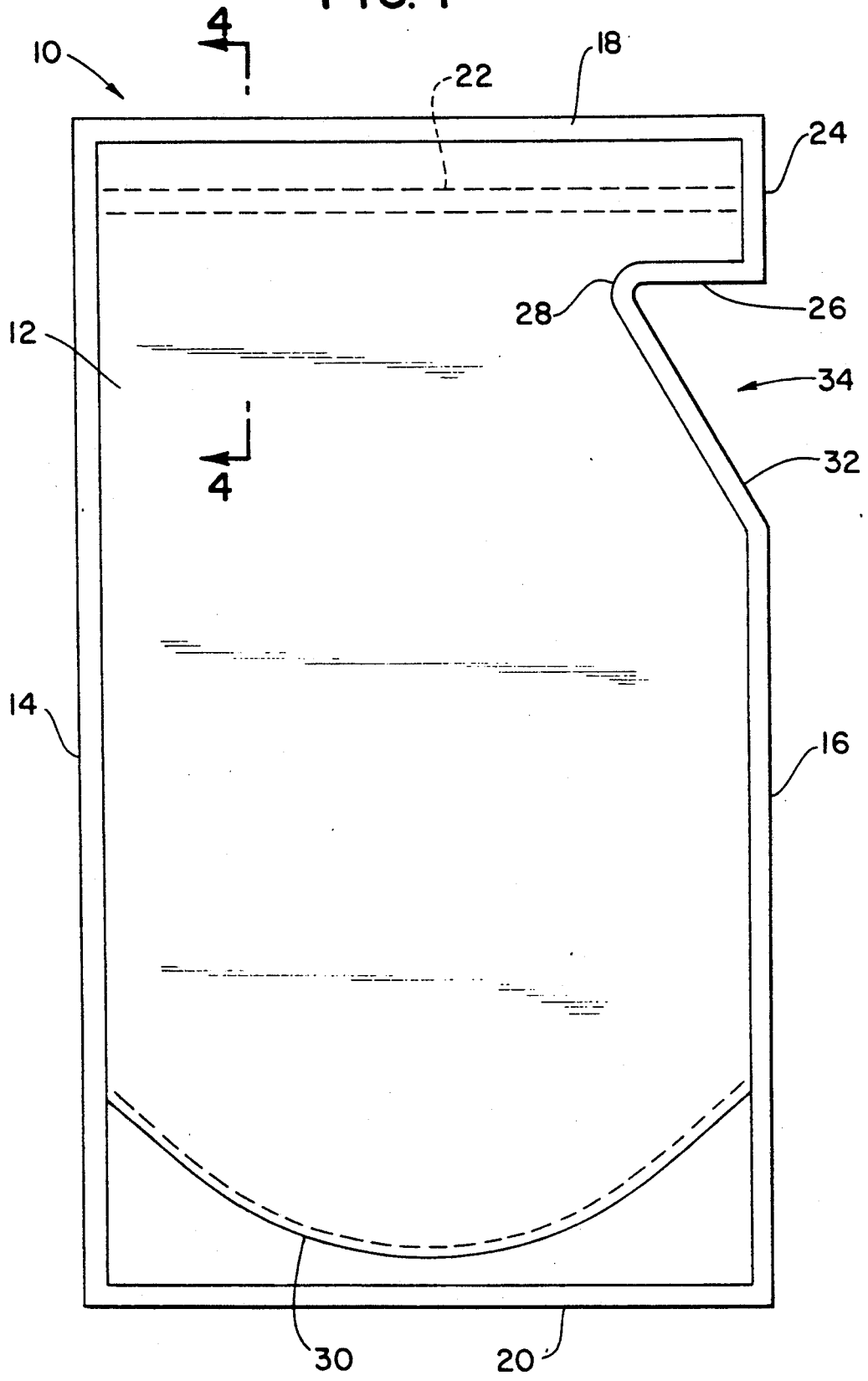
FIG. 1 is a side view of a flexible pouch with reinforcement in accordance with a first preferred embodiment of the invention.
Figure 2:
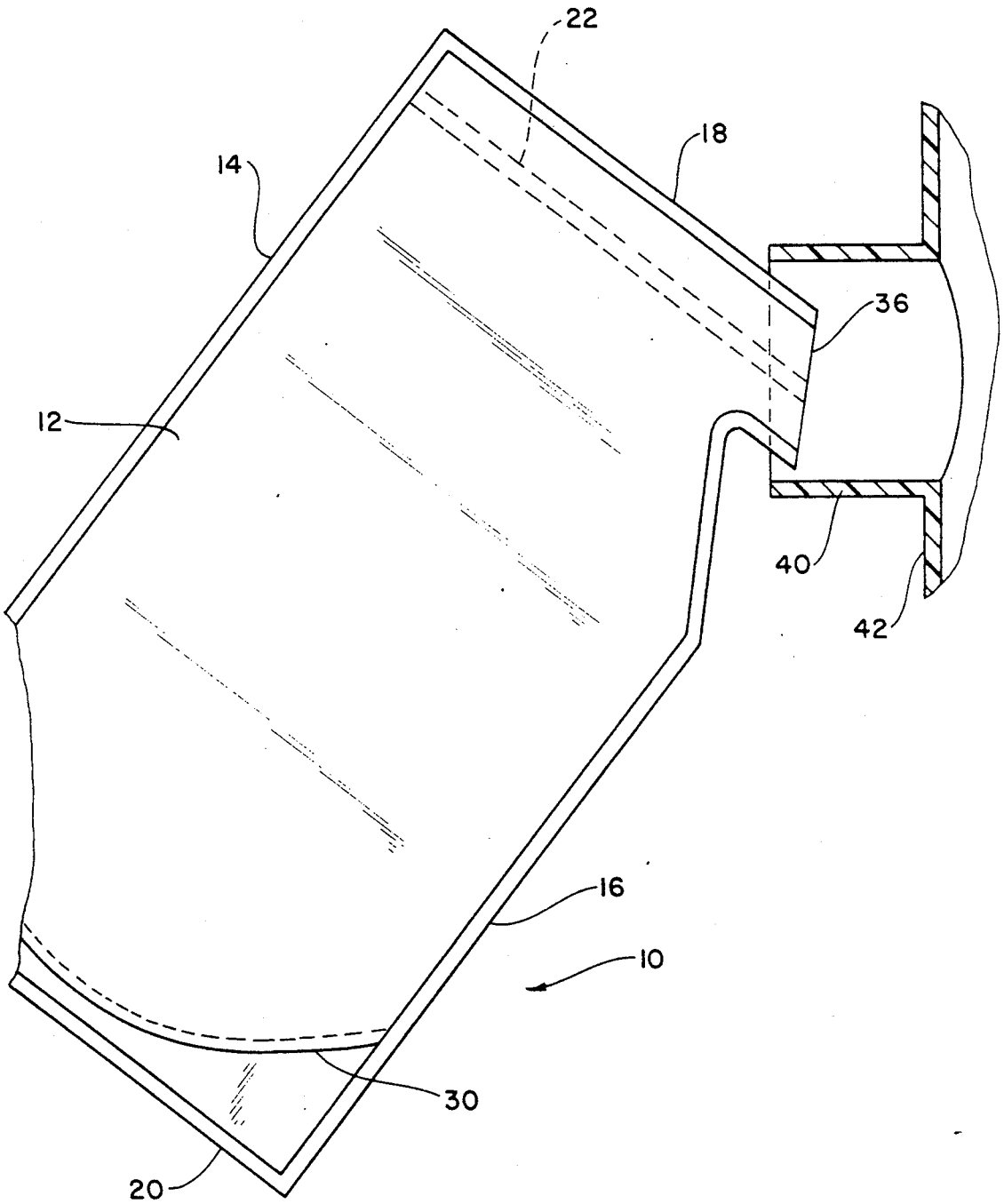
FIG. 2 is a partial side view of the flexible pouch of FIG. 1 with the spout open and a partial sectional view of the neck of a container to be filled in which the open spout has been inserted.
Figure 3:
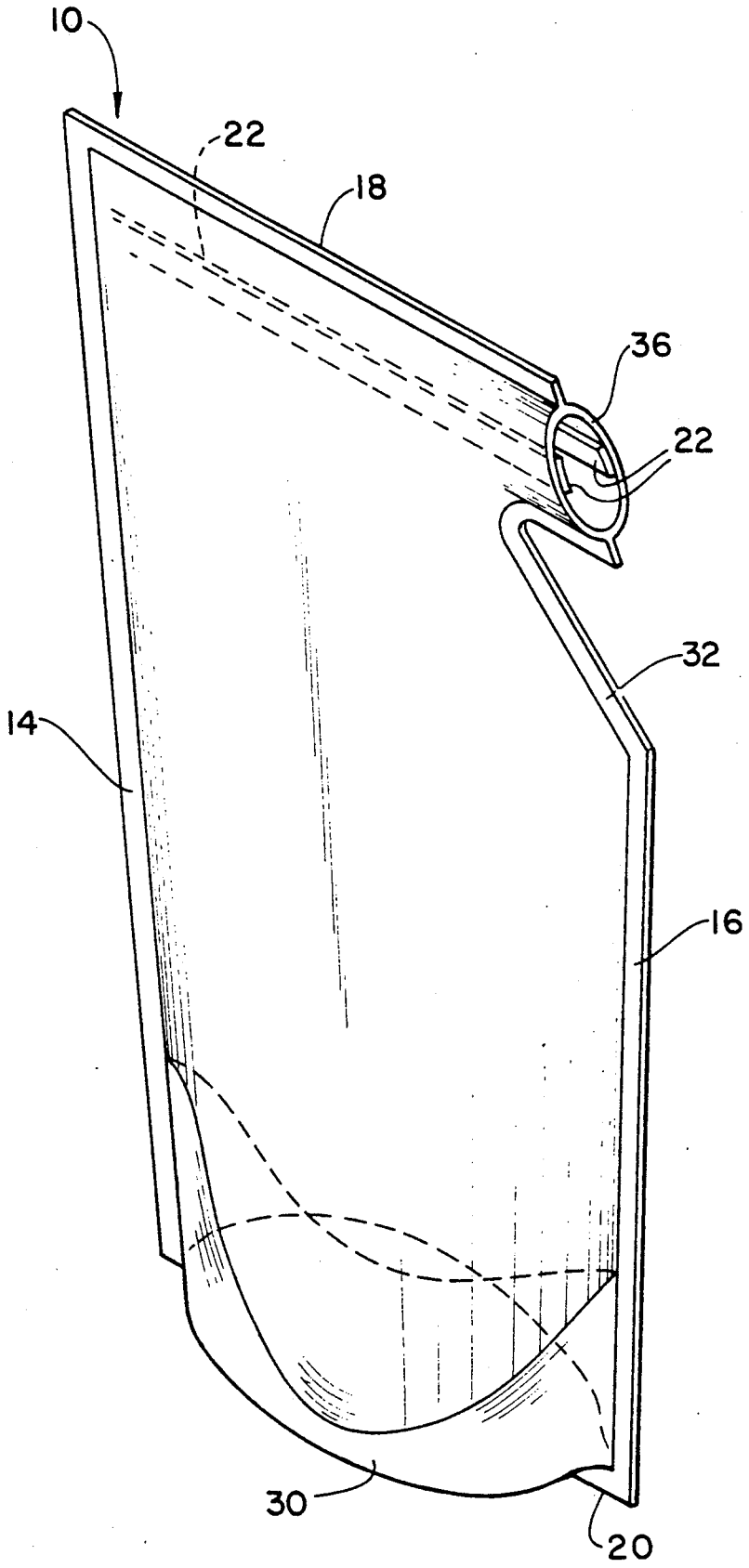
FIG. 3 is a perspective view of the flexible pouch of FIG. 1 with the spout open.

In accordance with the first preferred embodiment of the invention depicted in FIGS. 1-3, pouch 10 is constructed from two sheets 12 of flexible wall material which are sealed together along their peripheral edges to form a closed inner chamber for holding a liquid. The wall material is preferably transparent or translucent plastic of a type which will not react with the ingredients in the liquid to be stored in the pouch chamber.

During manufacture, two sheets 12 of wall material having the same shape are arranged against each other with their peripheries mutually overlapping. The corresponding peripheral edges 14, 16, 18 and 20 are bonded by heat sealing, sonic welding, adhesive or like means to form a closed inner chamber of the pouch. The bottom edge 20 may be gusseted along contour 30 to enable the pouch to stand upright when filled with liquid.

Alternatively the chamber could be formed from a single sheet of wall material by folding the wall material and then bonding the overlapping portions of the periphery of the single sheet.

After the first bonding operation, a recess 34 is formed in the respective sheets of wall material by cutting along side peripheral edge 16. This recess has a maximum height which is greater than the maximum depth measured in a direction transverse to the direction along which the height is measured. Further, in accordance with the first preferred embodiment of the invention, the recess begins at a point spaced from the top of the pouch. After recess 34 is formed, the respective sheets of wall material are bonded by heat sealing, sonic welding, adhesive or like means along the rim of the recess to again close off the pouch chamber.

In accordance with the first preferred embodiment of the invention, the bonded edge of the recess 34 has a generally inwardly curved portion 28 with generally straight portions 26 and 32 extending therefrom. Portion 26 is substantially parallel to top peripheral edge 18 of the pouch.

Recess 34 defines a closed pouring spout 24. The contour depicted in FIG. 1 maximizes the storage capacity of the pouch, enhances the structural strength at the pouring spout and permits refilling of containers having necks of different diameters.

Figure 4:
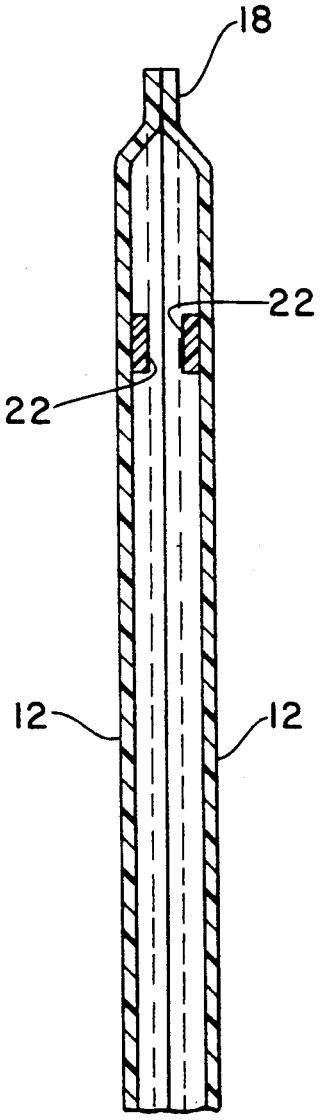
FIG. 4 is a detailed view taken along section 4—4 of FIG. 1 and illustrating the reinforcement of the inside of the flexible pouch in accordance with the first preferred embodiment of the invention.
Figure 5:
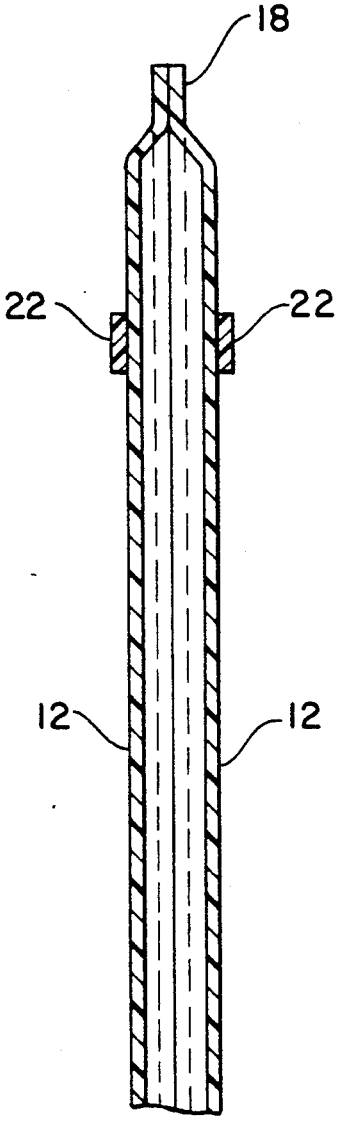
FIG. 5 is a detailed sectional view illustrating the reinforcement of the outside of the flexible pouch in accordance with the first preferred embodiment of the invention.
Figure 12:
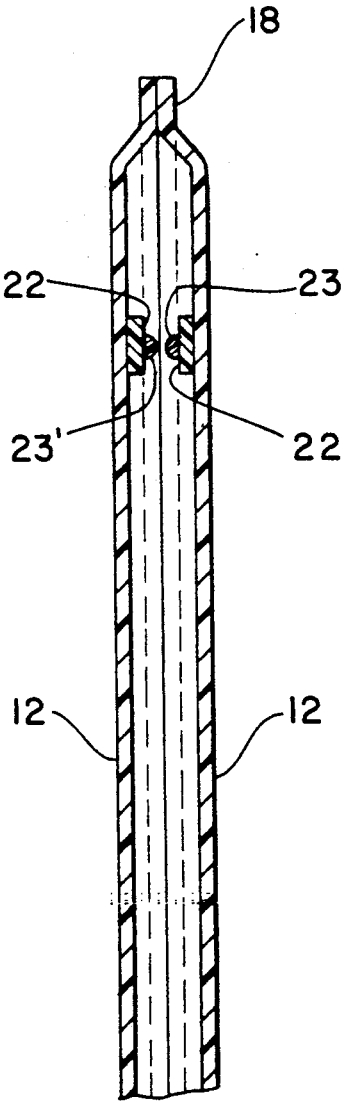
FIGS. 12 and 13 show two more alternative embodiments of the invention.
Figure 13:
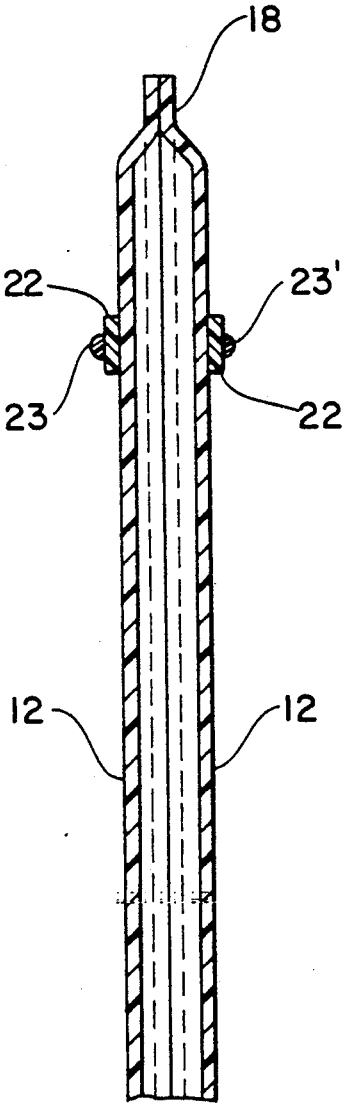

To prevent folding of the flexible pouch walls during pouring, reinforcement means 22 are arranged substantially parallel to the top peripheral edge 18 and extending from the closed spout 24. As best seen in FIGS. 3 to 5, the reinforcement means 22 in accordance with the first preferred embodiment of the invention comprise a pair of stiff strips bonded, for example, by welding or taping, to the inner surfaces of the opposing walls 12 of the pouch. The strip may further be provided with a longitudinal stiffening rib 23 (See FIGS. 12 and 13). Alternatively, the reinforcing means can take the form of a stiffening rib 23 secured to the inner wall surface by tape. Any material of sufficient stiffness may be used to reinforce the top portion of the pouch to prevent folding in the vicinity of the pouring spout, including wood, metal, or plastic.

In accordance with the first preferred embodiment, the reinforcement means 22 can be bonded to the outer surfaces of the opposing walls 12 of the pouch, as depicted in the sectional view of FIG. 5. In either case the reinforcement means should be bonded to the walls before the top peripheral edges 18 of the walls are bonded.

It is obvious to a practitioner of ordinary skill in the art of packaging that the reinforcement means need not be limited to strips of stiff material, but rather a stiff mesh or reinforced tape could be used with equal effectiveness.

FIG. 2 depicts the refilling of a container 42 by inserting the open spout of pouch 10 in open neck 40. Spout 24 is opened by cutting along line A—A (see FIG. 1). Cut A—A should be made at an angle of 30 to 60 degrees with respect to the top peripheral edge 18, preferably 45 degrees. A 45-degree cut permits the liquid contents of the pouch to be readily drained through spout opening 36 and into neck 40 of container 42.

Figure 6:
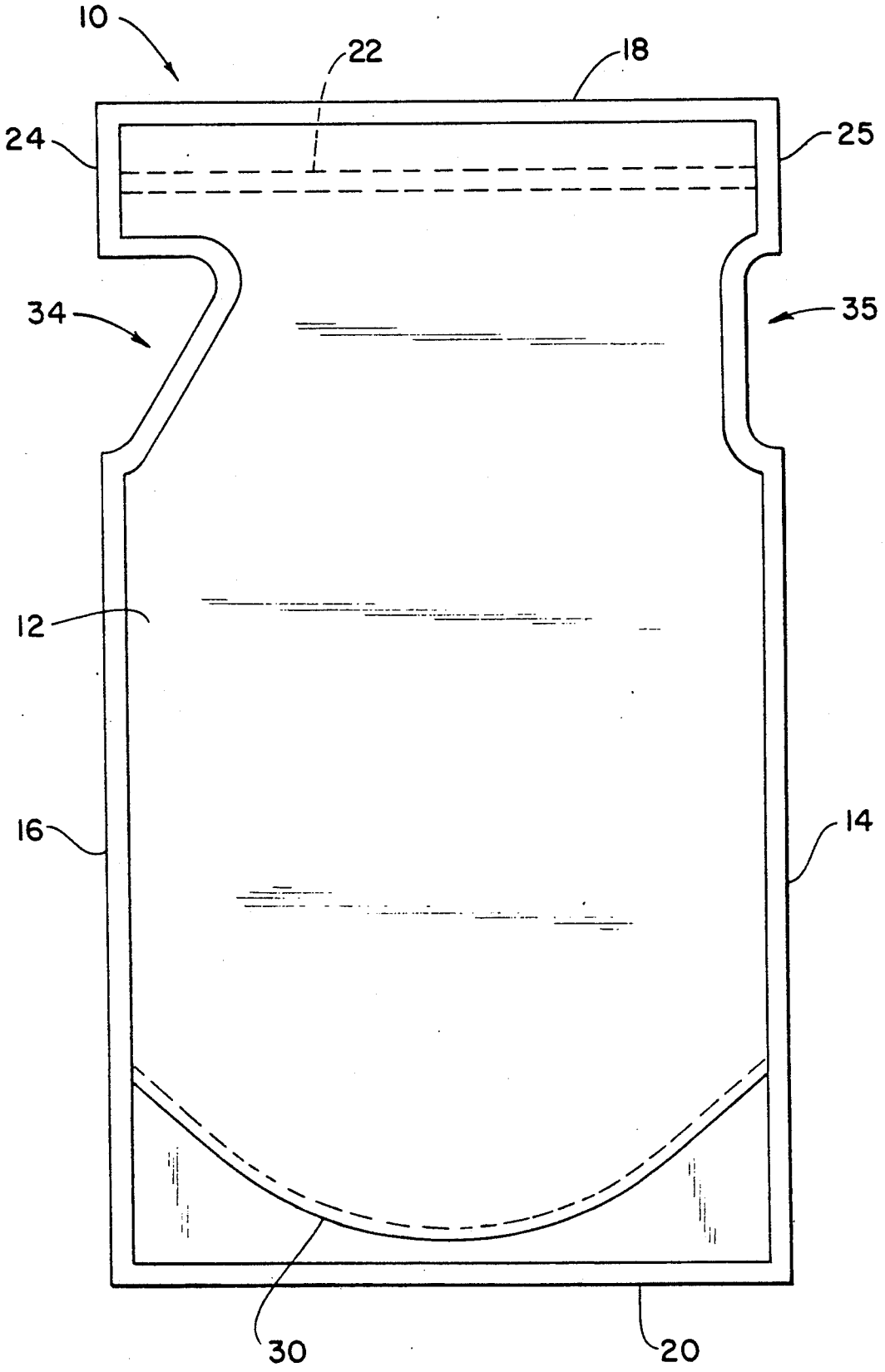
FIG. 6 is a side view of a flexible pouch with reinforcement in accordance with a second preferred embodiment of the invention.

In accordance with a second preferred embodiment of the invention depicted in FIG. 6, pouch 10 is constructed from two sheets 12 of flexible wall material which are bonded together along their peripheral edges to form a closed inner chamber for holding liquid. The wall material is preferably transparent or translucent plastic of a type which will not react with the ingredients in the liquid to be stored in the pouch chamber.

During manufacture, two sheets 12 of wall material having the same shape are arranged against each other with their peripheries mutually overlapping. The corresponding peripheral edges 14, 16, 18 and 20 are bonded to form a closed inner chamber of the pouch. The bottom edge 20 may be gusseted along contour 30 to enable the pouch to stand upright when filled with liquid.

After the first bonding operation, recesses 34 and 35 are formed in the respective sheets of wall material by cutting along side peripheral edges 16 and 14 respectively. Each recess has a maximum height which is greater than the maximum depth measured in a direction transverse to the direction along which the height is measured. Further, in accordance with the embodiment of FIG. 6, each recess begins at a point spaced from the top peripheral edge 18 of the pouch. After recesses 34 and 35 are formed, the respective sheets of wall material are bonded along the edges of the recesses to again close off the pouch chamber. Recesses 34 and 35 respectively define closed pouring spouts 24 and 25.

The second recess can be formed simultaneously with information of the first recess in the pouch. Moreover, if the pouches are formed in succession by bonding sheet material unrolled from continuous webs, the recesses in different pouches can be advantageously formed simultaneously.

The walls can be formed from 12-micron-thick polyethylene terephthalate film laminated to 152-micron-thick linear low-density polyethylene film, whereas the reinforcement strip with stiffening rib can be formed with a 150-micron-thick polyethylene strip secured to the walls by adhesive. The dimensions of the pouch in a preferred embodiment are as follows: width—130 mm; height—230 mm; width of juncture—5 mm; height of spout—18 mm; length of reinforcing strip—11.5 cm; width of stiffening rib—1.2 mm.

Figure 7:
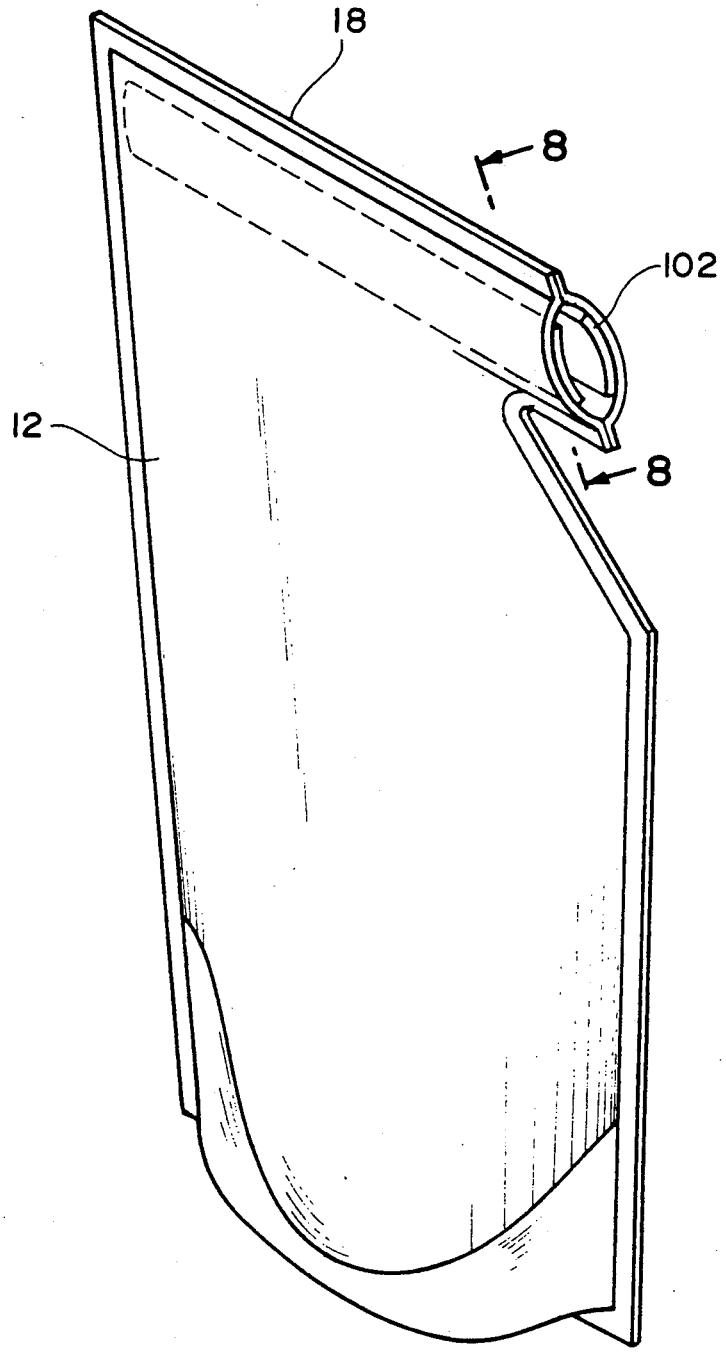
FIG. 7 is a perspective view of a flexible pouch with a modified form of reinforcement to prevent foaming in accordance with a third preferred embodiment of the invention.
Figure 8:
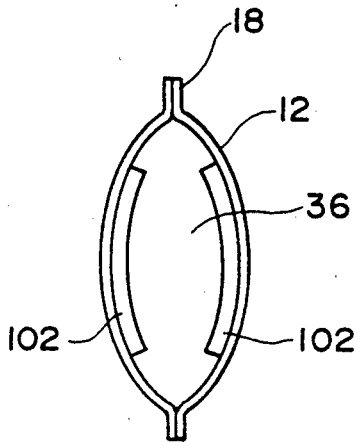
FIG. 8 is a detailed view taken along section 8—8 of FIG. 7 and illustrating the reinforcement of the inside of the flexible pouch in accordance with the third preferred embodiment of the invention.
Figure 9:
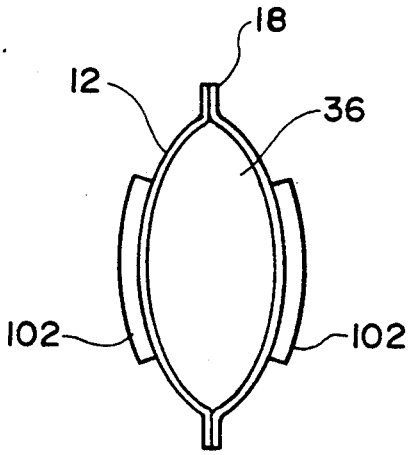
FIG. 9 is a detailed sectional view illustrating the reinforcement of the outside of the flexible pouch in accordance with the third preferred embodiment of the invention.

FIGS. 7 to 9 depict a flexible pouch with a modified form of reinforcement to prevent foaming in accordance with a third preferred embodiment of the invention. Reinforcement means 102 comprise a pair of arched strips made of suitably stiff material, such metal, plastic or wood. Strips 102 can be bonded to either the inner or outer wall surfaces in the vicinity of top peripheral edge 18, as respectively shown in FIGS. 8 and 9. The reinforcing strips 102 terminate at the spout opening 36.

Figure 10:
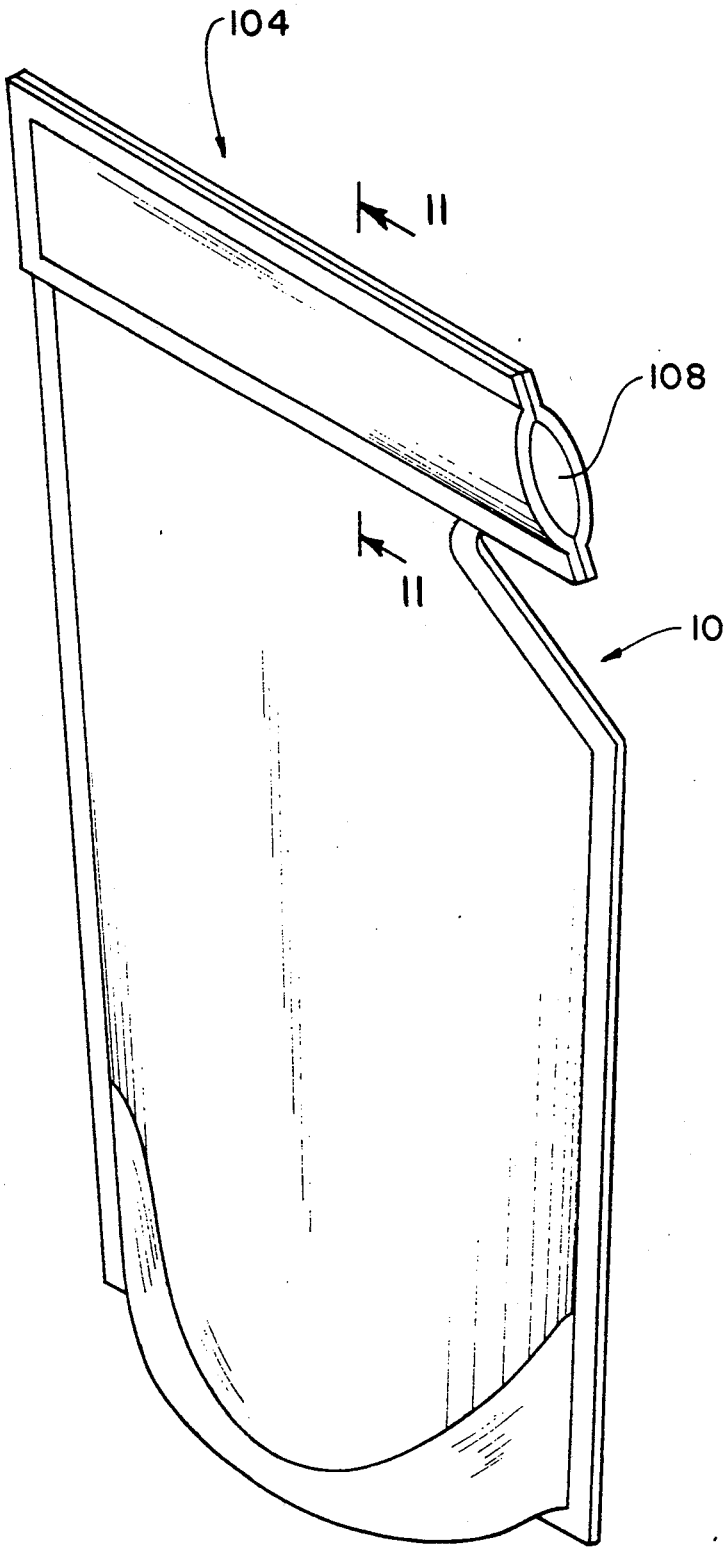
FIG. 10 is a perspective view of a flexible pouch with a rigid fitment attached to the wall material in accordance with a fourth preferred embodiment of the invention.
Figure 11:
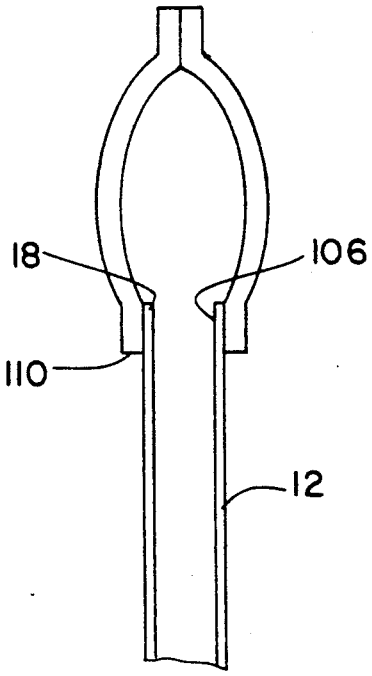
FIG. 11 is a detailed view taken along section 11—11 of FIG. 10 and illustrating the flexible pouch with rigid fitment in accordance with the fourth preferred embodiment of the invention.

In accordance with a fourth embodiment of the invention, depicted in FIGS. 10 and 11, the top peripheral edges of pouch walls 12 are not directly bonded to each other. Instead each top peripheral edge 18 is bonded to a respective inner surface 110 of a reinforcing fitment 104 made of relatively stiff material such as molded plastic. An opening 106 is thus formed which allows fluid communication between the pouch chamber and the fitment in interior. The interior of fitment 104 forms a channel of oval cross section which in turn communicates with spout opening 108 which is formed in the fitment. Fitment 104 is sufficiently stiff to ensure that when the pouch is tipped upside-down, the fluid from the pouch chamber which enters the fitment will drain without foaming via spout opening 108 into the container to be refilled. Alternatively, the top peripheral edges 18 could be bonded to respective outer surfaces of fitment 104.

Numerous modifications are possible in light of the above disclosure. For example, the preferred pouch 10 includes sheet walls 12 which are bonded together at their peripheral edges 14–20 to define an inner chamber. A bottom edge 20 is gusseted along contour 30 to provide a self-standing feature. Alternatively, the pouch could be formed from a single folded sheet bonded at its overlapping edges, and a contoured gusseted insert. Similarly, although the spout 24 is preferably opened by cut A—A at a 45-degree angle relative to the peripheral edge 18, this angular relation is not critical.

What is claimed is:

1. A flexible pouch for storing liquid therein, comprising first and second flexible walls made of sheet material, said first and second flexible walls being bonded along their periphery by means of a sealed juncture, said first and second flexible wall and said sealed juncture defining a closed chamber, said pouch having a shape with a recess for defining a spout when said walls are cut along a predetermined line, said pouch having a stiffening strip of material secured to one of an inner and outer surface of one of said first and second walls in the region of the spout for supporting said first and second wall of the spout in an open condition upon liquid being dispensed from the spout.

2. The flexible pouch as defined in claim 1, wherein said strip of material is secured to an inner surface of one of the said first and second walls.

3. The flexible pouch as defined in claim 2, wherein said strip of material has a stiffening rib secured thereto.

4. The flexible pouch as defined in claim 1, wherein said strip of material is secured to an outer surface of one of said first and second walls.

5. The flexible pouch as defined in claim 4, wherein said strip of material has a stiffening rib secured thereto.

6. A pouch for storing liquid therein, comprising first and second flexible walls made of sheet material, said first and second flexible walls being bonded along at least part of their peripheries by means of a sealed juncture, said first and second flexible walls and said sealed juncture defining a chamber capable of holding a liquid;

a spout for providing a channel for the discharge of said liquid held by said bonded walls; and supporting means comprising a stiffening strip of material secured to one of an inner and outer surface of one of said first and second walls in the region of the spout for forming an open channel for flow of said liquid held by said chamber through said spout.

7. The pouch as defined in claim 6, wherein said strip of material is secured to an inner surface of one of said first and second walls.

8. The pouch as defined in claim 7 wherein said strip of material has a stiffening rib secured thereto.

9. The pouch defined in claim 6, wherein said strip of material is secured to an outer surface of one of said first and second walls.

10. The pouch as defined in claim 9 wherein said strip of material has a stiffening rib secured thereto.

* * * * *